US005106702A

United States Patent [19]

Walker et al.

[11] Patent Number: 5,106,702

[45] Date of Patent: Apr. 21, 1992

[54] REINFORCED ALUMINUM MATRIX COMPOSITE

[75] Inventors: J. Andrew Walker, Greenville, S.C.; Edgar A. Starke, Jr., Charlottesville, Va.; Paul W. Niskanen, Greer, S.C.

[73] Assignee: Advanced Composite Materials Corporation, Greer, S.C.

[21] Appl. No.: 228,119

[22] Filed: Aug. 4, 1988

[51] Int. Cl.[5] ..... C22C 32/00

[52] U.S. Cl. ..... 428/614

[58] Field of Search ..... 428/614

[56] References Cited

U.S. PATENT DOCUMENTS

| | | | |
|---|---|---|---|
| 3,826,688 | 7/1974 | Levy | 148/2 |
| 4,336,075 | 6/1982 | Quist et al. | 148/2 |
| 4,463,058 | 7/1984 | Hood et al. | 75/229 |
| 4,605,440 | 8/1986 | Halverson et al. | 75/238 |

FOREIGN PATENT DOCUMENTS

| | | | |
|---|---|---|---|
| 188704 | 7/1986 | European Pat. Off. . | |
| 0204319 | 12/1986 | European Pat. Off. | 428/614 |
| 0205084 | 12/1986 | European Pat. Off. | 428/614 |
| 0207314 | 1/1987 | European Pat. Off. | 428/614 |
| 213615 | 3/1987 | European Pat. Off. . | |
| 223478 | 5/1987 | European Pat. Off. . | |
| 0235574 | 9/1987 | European Pat. Off. | 428/614 |
| 0236729 | 9/1987 | European Pat. Off. | 428/614 |
| 3522166 | 8/1986 | Fed. Rep. of Germany . | |
| 2072815 | 9/1971 | France . | |
| 57-98647 | 6/1982 | Japan | 428/614 |
| 57-114629 | 7/1982 | Japan | 428/614 |
| 57-114630 | 7/1982 | Japan | 428/614 |
| 58-1050 | 1/1983 | Japan | 428/614 |
| 58-141356 | 8/1983 | Japan | 428/614 |
| 59-50149 | 3/1984 | Japan | 428/614 |
| 59-118864 | 7/1984 | Japan | 428/614 |
| 59-162242 | 9/1984 | Japan | 428/614 |
| 61-279645 | 12/1986 | Japan | 428/614 |
| 61-279646 | 12/1986 | Japan | 428/614 |
| 61-279647 | 12/1986 | Japan | 428/614 |
| 62-10236 | 1/1987 | Japan | 428/614 |
| 62-89837 | 4/1987 | Japan | 428/614 |
| 62-182235 | 6/1987 | Japan . | |
| 62-161932 | 7/1987 | Japan | 428/614 |
| 62-180024 | 8/1987 | Japan | 428/614 |
| 62-199740 | 9/1987 | Japan | 428/614 |
| 63-199839 | 8/1988 | Japan | 428/614 |
| 63-96229 | 9/1988 | Japan . | |
| 63-136327 | 9/1988 | Japan . | |
| 1338088 | 11/1973 | United Kingdom . | |
| 2176804A | 1/1987 | United Kingdom . | |

OTHER PUBLICATIONS

Nutt, "Interfaces and Failure Mechanisms in Al-Sic Composites", Mar. 2-6, 1986, pp. 157-167.

Nutt and Duva, "A Failure Mechanism in Al-Sic Composites", 1986, pp. 1055-1058.

Nutt and Needleman, "Void Nucleation at Fiber Ends in Al-Sic Composites", 1987, pp. 705-710.

Nutt and Carpenter, "Non-equilibrium Phase Distribution in an Al-Sic Composite", 1985, pp. 169-177.

Bates, "Ductility and Toughness Improvement Program", Apr., 1985. (abstract only).

Niskanen, "The Aluminum/SiCw MMC Damage Tolerance/Ductility Enhancement Program: An Overview", Jul. 1986. (abstract only).

Bates and Waltz, "Metal Matrix Composite Structural Demonstration Program", Jul., 1986. (abstract only).

Bates and Hughes, "Metal Matrix Composite Structural Demonstration Program", May 26-28, 1987. (abstract only).

*Primary Examiner*—Theodore Morris

*Assistant Examiner*—David Schumaker

*Attorney, Agent, or Firm*—Banner, Birch, McKie & Beckett

[57] ABSTRACT

A reinforced aluminum matrix composite having improved toughness and ductility over known composites, without any sacrifice in strength or stiffness. In particular, the invention relates to a reinforced aluminum alloy consisting essentially of copper and magnesium as the principal alloying elements. The alloy may have other soluble alloying elements up to their solubility limits in the base alloy. The alloy may include a small percentage of insoluble metallic elements in amounts which do not adversely affect the sought after improvements in ductility and toughness. The reinforcement may be either a ceramic material, in the form of whiskers, particles, or chopped fibers, or a metal.

18 Claims, 10 Drawing Sheets

SXA®24/20$_W$-T6

| | | |
|---|---|---|
| $F_{tu}$ | (ksi) | 125 |
| $F_{ty}$ | (ksi) | 72 |
| E | (Msi) | 18.4 |
| e | (%) | 2.3 |
| $K_{icsr}$ | (ksi$\sqrt{in}$) | - |

EXTRUDED ROD 17:1

SXA®220/20$_W$-T6

| | | |
|---|---|---|
| $F_{tu}$ | (ksi) | 119 |
| $F_{ty}$ | (ksi) | 74 |
| E | (Msi) | 18.5 |
| e | (%) | 3.5 |
| K | (ksi$\sqrt{in}$) | 22.5 |

100 HOUR EXPOSURE
T3E1 TEMPER
COMPOSITE
SXA°221/15w
SXA°214/15w
SXA°266/15w
SXA°24/15w
SXA°260/15w
SXA°264/15w
ELONGATION
TO FAILURE (%)
TEST TEMPERATURE (°F)
0
5
10
15
20
25
30
100
200
300
400
500
600

REINFORCED ALUMINUM MATRIX COMPOSITE

BACKGROUND OF THE INVENTION

This invention relates to a reinforced aluminum matrix composite having improved toughness and ductility over known composites, without any significant sacrifice in strength or stiffness. In particular, the invention relates to a reinforced aluminum alloy consisting essentially of soluble amounts of copper and magnesium as the principal alloying elements. The alloy of the invention also may include other soluble alloying elements, alone or in combination, such as silicon, silver, or zinc, up to their solubility limits in the base alloy. Insoluble metallic elements, such as manganese, chromium, iron, and zirconium are eliminated or minimized.

Aluminum alloys are well-known and commonly used engineering materials. It is also well-known that incorporation of discontinuous silicon carbide reinforcement, such as particulate, whiskers, or chopped fiber, into an aluminum alloy matrix produces a composite with significantly higher yield strength, tensile strength and modulus of elasticity than the matrix alloy alone. However, the addition of silicon carbide whiskers to conventional alloys results in a composite with poor ductility and fracture toughness, and thus limited industrial application.

Several studies have suggested that the reason known silicon carbide whisker reinforced aluminum alloys have poor ductility and toughness is void nucleation at the whisker ends. The whisker ends are believed to be the sites of stress concentrations. Microstructural damage at these sites results in void initiation, interface decohesion, and whisker cracking. Eventually, there are sufficient openings created to form a fracture path. A 1986 study by S. R. Nutt entitled "Interfaces and Failure Mechanisms in Al-SiC Composites" made the above observations and concluded that since most sites at which damage is initiated involve the whisker reinforcements, there may be a fundamental limitation to the ductility of whisker reinforced aluminum alloys which cannot be overcome by modifications to the alloy content. Contrary to this generally accepted view, the present invention modifies the alloy content of the aluminum matrix to provide a ceramic reinforced aluminum matrix composite with ductility and fracture toughness superior to that of a composite using a conventional alloy matrix. Moreover, the composite of the invention achieves improved fracture toughness and ductility without a significant sacrifice of strength and stiffness.

Another previous alloy development program, which evaluated different, conventional, ceramic reinforced aluminum alloy matrices, agreed with the hypothesis that SiCw reinforcement dominates the failure process, and concluded that the matrix alloy has, at most, a minor role in determining the elongation to fracture. It was found that independent of the matrix alloy or temper, all high strength composites made with conventional aluminum alloys had elongations to failure of about 2.5%. It was thus believed that the strength and ductility of the composites could not be improved by using different aluminum alloys. Again, this previously accepted position is contrary to the findings of the present invention.

Previously known composite materials have used conventional heat treatable aluminum alloys, defined according to the Aluminum Association Classification System, as matrices for reinforcement by a ceramic material. One commonly used aluminum alloy is alloy 2124. 2124 consist essentially of 3.8–4.9% copper, 1.2–1.8% magnesium, 0.3–0.9% manganese, up to 0.2% silicon, and up to 0.3% iron. This alloy has generally been reinforced with silicon carbide whiskers. Because the silicon carbide used for reinforcement is discontinuous, this composite can be fabricated with conventional metal working technology.

Silicon carbide reinforced aluminum matrix composite materials are often known by the SXA ® trademark. For example, SXA ® 24/SiC is a composite of alloy 2124 reinforced with SiC. The strength and stiffness of extruded, forged or rolled SXA ®24/SiC is significantly greater than existing high strength aluminum alloys. The light weight and improved strength and stiffness of SXA ®24/SiC make it a useful material in many industrial applications. For example, it can improve the performance and reduce the life-cycle cost of aircraft. However, the ductility and toughness of SXA ®24/SiC is too low for many aircraft components where damage tolerance and ductility is critical. This has prohibited the use of conventional ceramic reinforced alloys in aircraft and similar applications to which they would otherwise appear to be ideally suited.

Upon tensile loading, SXA ® composite made with conventional matrix alloys, like 2124, fracture catastrophically without the onset of necking. In SXA ®24-/$SiC_w$, examinations of fractured specimens have shown that fracture usually initiates at large particles having dimensions less than 50 um, such as insoluble intermetallic particles, coarse silicon carbide particulate contaminants which accompany the $SiC_w$, and agglomerates of $SiC_w$. Upon crack initiation, fracture propagates by a dimple rupture mechanism, where SiC reinforcement is the principle site for microvoid nucleation. One study of a composite made from alloy 2124 reinforced with 15 vol. % $SiC_w$ suggested that this fact implied that the large insoluble intermetallic dispersoids and constituent particles are fracture nucleation centers, and that the large variety of precipitates and dispersed particles within the matrix are the primary cause of the small strain to fracture. It was hypothesized that if the intermetallic dispersoids were removed, the fracture behavior would be dominated by the reinforcing fibers.

One type of large insoluble intermetallic particle formed in a composite made using a conventional alloy for the matrix is formed by transition elements, which are deliberate and necessary alloy elements in the unreinforced alloy. The transition elements serve to retain the best combination of strength, damage tolerance, and corrosion resistance. For instance, manganese is a critical addition to 2124, which precipitates submicron $Al_{20}Mn_3Cu_2$ particles during the ingot preheat and homogenization treatment phases of preparing the alloy. These particles are generally referred to as dispersoids. The dispersoid particles are virtually insoluble and have a dual, but contradictory, role in unreinforced alloys. By suppressing recrystallization and grain growth, the dispersoids promote transgranular fracture which is associated with high toughness. However, dispersoids also promote fracture by nucleating microvoids and can thus reduce the transgranular fracture energy. Dispersoids like $Al_{20}Mn_3Cu_2$ in 2124 are not amenable to the composite consolidation process typically used in making ceramic reinforced aluminum alloy matrix composites. The slow cooling rate from the liquid/solid hot press consolidation temperature destroys the homogeneous, rapidly solidified microstructure of the gas atomized alloy powder and allows large intermetallic constituent particles of $(Mn,Fe,Cu)Al_6$ or $Al_{20}(MnFe)_3Cu_2$ to form in addition to the dispersoids.

Another type of insoluble intermetallic particle contains copper, an essential element which strengthens 2124 upon age hardening. The composition limits of alloy 2124 allow Cu to exceed the solubility limit of the Al-Cu-Mg system. Accordingly, x-ray diffraction has identified $Al_2Cu$ after solution heat treating, cold water quenching and natural aging of the composite, SXA ®24/SiC. When the copper bound to the compound $Al_{20}Mn_3Cu_2$ is considered, approximately 3.9% copper (at the nominal composition) is available to precipitate the strengthening phases upon natural or artificial aging. At this concentration, the ternary Al-Cu-Mg solvus shows that undissolvable soluble constituents can exist in the composite, as shown in FIG. 1. Complete dissolution of the soluble phases is not possible at the maximum customary 920° F. (493° C.) solution heat treatment temperature for 2124, which is used to avoid eutectic melting.

It has been found, however, in accordance with the present invention, that dispersoid particles may not be needed in a reinforced aluminum composite because the reinforcement and dispersed aluminum oxide (which is an impurity introduced with the aluminum powder) appear to give adequate control of grain size. Thus, omitting insoluble metallic elements, such as manganese, from 2124, while retaining the elements needed for strengthening by age hardening, would eliminate the large intermetallic particles responsible for premature crack initiation. Omitting the dispersoids likely improves the fracture toughness of the composite by increasing the transgranular fracture energy of the matrix alloy. Since the amount of ceramic reinforcement is not changed, strength and stiffness of the composite are maintained.

In summary, ceramic reinforced aluminum alloy composites made with conventional alloys, such as 2124, form insoluble and undissolved soluble constituents which can not be eliminated by prolonged homogenization. These constituents are a permanently installed, deleterious component of the matrix microstructure. Thus, in accordance with the present invention, control of the type and amount of alloying is needed to eliminate the constituents which act as sites for crack initiation and propagation at small (2.0%–2.5%) strains.

SUMMARY OF THE INVENTION

The reinforced aluminum alloy matrix composites of the present invention comprise an aluminum alloy matrix consisting essentially of aluminum and alloying elements of copper and magnesium. The alloy may also include other soluble alloying elements, such as silicon, silver, or zinc, up to their solubility limits in the base alloy. Preferably, the alloy of the invention has a minimum of insoluble metallic elements, such as manganese, chromium, iron, or zirconium. The strength, stiffness, ductility and fracture toughness will vary according to alloy content, percentage of insoluble metallic elements, temper and type and amount of reinforcement. Ideally, the insoluble metallic elements are completely eliminated from the alloy. In practice, based on the other constituents of the composite, the ultimate use of the composite, and the ductility and fracture toughness requirements, the alloy may have a small percentage of insoluble metallic elements. In the preferred forms of the invention, the alloy of the invention has less than approximately 0.2% insoluble metallic elements. Preferably, the reinforced composite of the invention uses an aluminum alloy consisting essentially of soluble amounts of copper and magnesium within the ranges of 2.0–4.5% copper and 0.3–1.8% magnesium. In its preferred form, the alloy of the invention is reinforced with either ceramic particles, whiskers, or chopped fibers. Silicon carbide is the preferred ceramic reinforcing material. However, metallic reinforcement, such as tungsten, also may be used.

The invention provides a matrix alloy composition for a reinforced composite which imparts to the composite ductility and toughness superior to that obtained using a conventional alloy matrix without causing a significant sacrifice of strength and stiffness.

DETAILED DESCRIPTION

Figure 1:
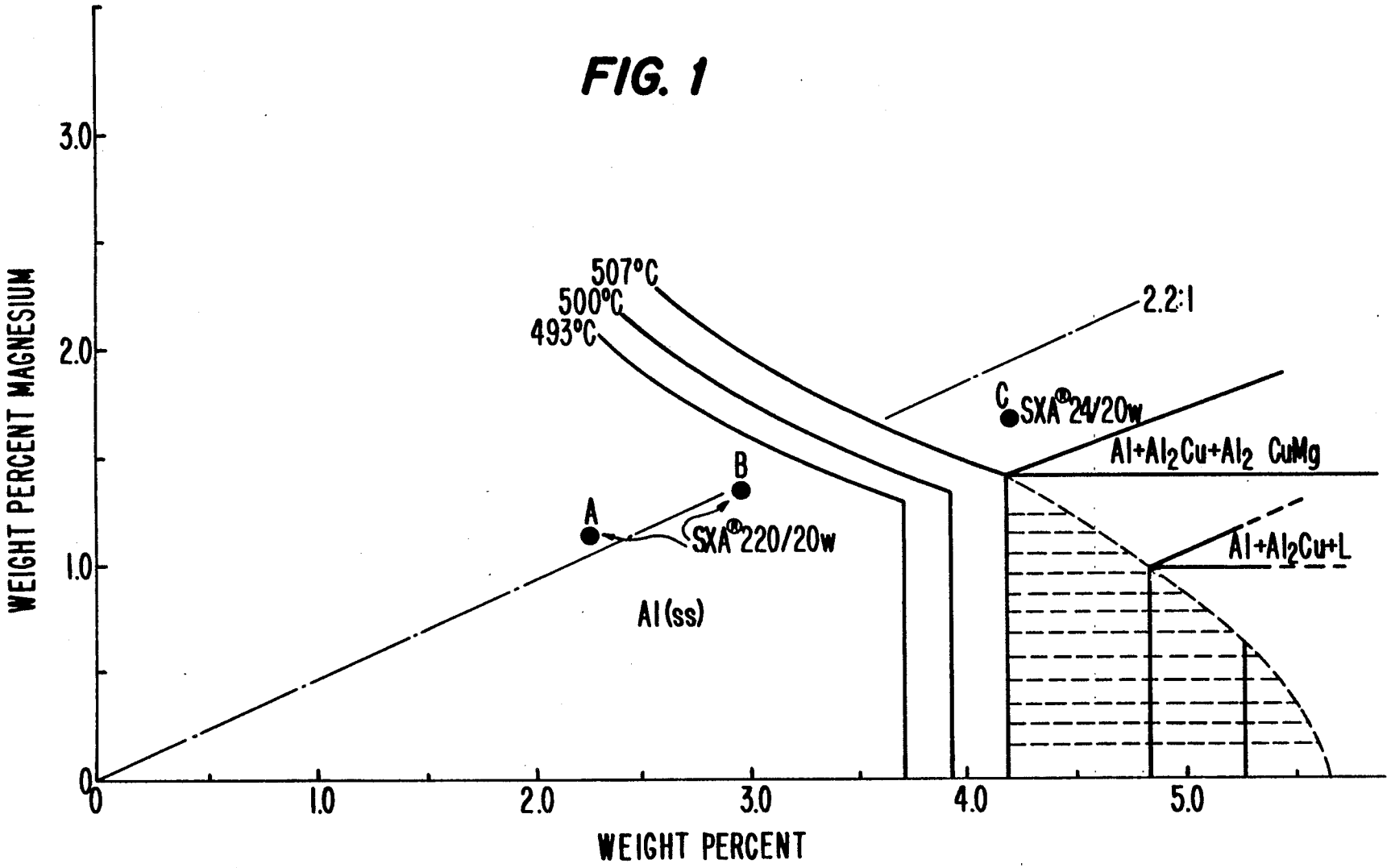
FIG. 1 is as Al-Cu-Mg solvus diagram comparing characteristic of two composites of the present invention and a conventional composite.

It has been found that ductility and fracture toughness of a reinforced aluminum matrix composite can be improved significantly by eliminating, or at least minimizing, elements which form intermetallic dispersoid partcles in conventional or powder metallurgical aluminum alloys. These elements are unnecessary and deleterious to ductility and toughness. Also, the copper/magnesium matrix alloys of the invention consists essentially only of elements needed for strengthening. The total concentration of strengthening elements does not exceed their solubility limit, established by the maximum safe solution heat-treat temperature. This allows complete dissolution of the intermetallic particles during homogenization and solution heat treatment. The preferred tempers for the matrix alloys of the invention are the natural-aged T3 or T4 conditions. Artificial aging to a T6 or T8 condition improves strength but sacrifices the ductility which is the limiting property of conventional SXA ®24/SiC.

In accordance with the present invention, elements with low solubility in aluminum are omitted to limit or eliminate the formation of insoluble, dispersoid and constituent particles. Although trace additions of these elements may not be deleterious to toughness, high-purity raw materials are preferred so to minimize the amount of insoluble intermetallic particles. The strength, stiffness, ductility and toughness of the composite of the invention will vary according to alloy content, percentage of insoluble intermetallic elements, temper, and type and amount of reinforcement. In the preferred compositions as set forth below, about 0.4% of soluble trace elements may be present in the alloy, with a preferred range of less than 0.2%. Preferably the percentage of insoluble metallic elements will be less than approximately 0.2%. As the percentage of insoluble metallic elements increases, the ductility and toughness decreases.

Table 1 identifies the name and composition of several composite materials made according to the present invention. Two different groups of composites were tested. A first group included alloys reinforced with approximately 20 volume percent (vol. %) silicon carbide whiskers and aged to a T-6 temper. These composites were formed into rods and bars for testing. The tensile properties of these composites were tested at ambient temperature with a minimum 1 week exposure. A second group included alloys reinforced with approximately 15 vol. % silicon carbide whiskers and aged to a T-3 temper. These composites were formed into 0.1 inch thick sheet stock for testing. The tensile properties of these composites were tested at 225° F. (107° C.) with an exposure of 10–100 hours. All the examples tested were reinforced with silicon carbide whiskers, which is the preferred ceramic reinforcement. However, particles, whiskers, or chopped fibers of other ceramic materials may also be used to reinforce the alloy matrix. Also, the matrix alloy may be reinforced with a metal, such as tungsten. In addition to the alloys listed in Table 1, matrix alloys with a higher or lower Cu/Mg ratio (or an addition of silicon, silver, zinc or other soluble metallic elements) are also in accordance with the requirements of this invention and should provide properties superior to any conventional counterpart alloy, as explained in detail below.

TABLE 1

MATRIX COMPOSITE COMPOSITION

| Composite | Cu (wt. %) | Mg (wt. %) | $SiC_w$ (v. %) |
|---|---|---|---|
| SXA ® $214/15_w$ | 4.7 | — | 15.9 |
| SXA ® $264/15_w$ | 4.5 | 0.34 | 16.6 |
| SXA ® 266*$/15_w$ | 2.9 | 0.72 | 16.6 |
| SXA ® $260/15_w$ | 3.3 | 0.53 | 15.8 |
| SXA ® 221**$/15_w$ | 3.1 | 1.1 | 15.6 |
| SXA ® $220/20_w^{A}$*** | 2.27 | 1.08 | 20.9 |
| SXA ® $220/20_w^{B}$ | 2.95 | 1.37 | 19.3 |

*Also includes 0.27% silicon

**Also includes 0.08% zirconium

***Two different composites, both within the SXA ® 220 range, were tested. They have been labelled as "A" and "B"

The two sample SXA ®220 composites from Table 1 constitute the first group of composites. These composites were aged to a T-6 temper and were formed into rods and bars for testing, as explained below. The remaining sample composites in Table 1 constitute the second group. These composites were aged to a T-3 temper and were formed into 0.1 inch sheet stock for testing. These widely varying samples demonstrate the broad applicability of the invention.

As shown in Table 1, the matrix alloys of the invention consist essentially of soluble amounts of copper and magnesium as the principal alloying additions to form the base alloy. As shown in the SXA ®266 composite, the alloy may also include other soluble alloying elements. These other soluble elements should be included in amounts which do not exceed their solubility limits in the base alloy. As shown SXA ®266 included 0.27% silicon. The alloy of the invention may also include a small percentage of insoluble metallic elements. SXA ®221 includes 0.08% zirconium. Preferably, the percentage of insoluble metallic elements is kept below about 0.2%, as further explained below. However, the precise amount of the insoluble metallic elements may vary depending on the other components of the composite, the temper, reinforcement and the amount of improved ductility and toughness sought. In general, the percentage of insoluble intermetallic elements should be sufficiently small so that ductility and toughness are not adversely affected.

The alloy composition solvus is shown in FIG. 1. The composition range of the SXA ®220 matrix alloy resides within the single phase region which is bound by the isothermal solvus at about 932° F. (500° C.). Any composition which exceeds this solubility limit will form residual soluble intermetallic constituents which are deleterious to acceptable toughness and ductility. Progressive degradation in toughness is anticipated as the amount of residual intermetallic constituent increases. A progressive decrease in strength is expected as the concentration of strengthening elements is decreased below the amount that is in solution at 932° F. (500° C.). Given the same solution and precipitation-heat treatments, the matrix alloy of the invention will allow nearly commensurate age hardening as a 2124 matrix and will contain substantially fewer insoluble and residual soluble intermetallic particles to lower the toughness.

As shown in FIG. 1, points A and B represent the SXA ®$220^A$ and SXA ®$220^B$ alloys, respectively, as shown in Table 1. Point C on FIG. 1 represents a conventional 2124 alloy reinforced with 20 volume percent silicon carbide whiskers. In addition to the copper and magnesium alloying elements as shown in FIG. 1, the conventional 2124 alloy also included approximately 0.55% manganese and other metallic elements (see Table 3) which are not shown in FIG. 1.

To maintain strength, the matrix alloy of the present invention should preferably contain soluble amounts of copper and magnesium within the ranges of about 2.0 to 4.5% copper and about 0.3 to 1.8% magnesium. However, an alloy at both the upper percentages would contain a significant amount of insoluble metallics, which would diminish ductility; whereas an alloy at both the lower percentages would have diminished strength. Table 2 shows the ultimate tensile strength ($F_{tu}$), tensile yield strength ($F_{ty}$), and elongation to failure (e) of various second group composites made according to the present invention. The composites in Table 2 were aged to the T3E1 temper. FIGS. 7–10 are graphs of the tensile properties of the composites in Table 2. FIG. 5 shows similar data for a conventional 2124 alloy matrix reinforced with 20 volume percent silicon carbide whiskers and aged to a T6 condition (SXA ®24/$20_w$-T6) and a similarly reinforced and aged alloy according to the present invention (SXA ®220/$20_w$-T6).

Comparing the tensile properties of SXA ®214 and SXA ®264 as shown in Tables 1 and 2, it is readily seen that a small addition of magnesium provides significant gains in strength over an aluminum alloy having only copper as the alloying element. Also, the strength of SXA ®264, SXA ®266, and SXA ®221 are substantially similar, notwithstanding significant variations in alloy composition within the teachings and fundamental principals of the invention.

TABLE 2

Tensile Properties at 225° F. (10–100 hours exposure)

| Composite | Form | Tensile Strength (ksi) | Yield Strength (ksi) | Elongation to Failure (%) |
|---|---|---|---|---|
| SXA ® 214/$15_w$ | sheet | 78 | 57 | 7.8 |
| SXA ® 264/$15_w$ | sheet | 93 | 77 | 4.3 |
| SXA ® 266/$15_w$ | sheet | 94 | 78 | 5.2 |
| SXA ® 260/$15_w$ | sheet | 87 | 70 | 6.6 |
| SXA ® 221/$15_w$ | sheet | 92 | 77 | 4.3 |
| SXA ® 24/$15_w$ | sheet | 104 | 88 | 3.1 |

The amount of ceramic reinforcement can range from 5 to 40 volume percent depending on the type of reinforcement, whiskers, particles, or chopped fibers, and the strength of the matrix-alloy. A preferred range is 10–30 volume percent. As shown in Table 1, the test samples used 15–20 volume percent silicon carbide whisker reinforcement. Preferably silicon carbide whiskers ($SiC_w$) or silicon carbide particles (SiCp) are used to reinforce the alloy matrix. However, other ceramic materials such as silicon nitride, titanium nitride, titanium carbide, aluminum nitride, alumina, boron carbide, boron, magnesium oxide and graphite also may be used as reinforcing materials in either particle, whisker or chopped fiber form. A metallic reinforcement, such as tungsten, may be used also.

Figure 2A:
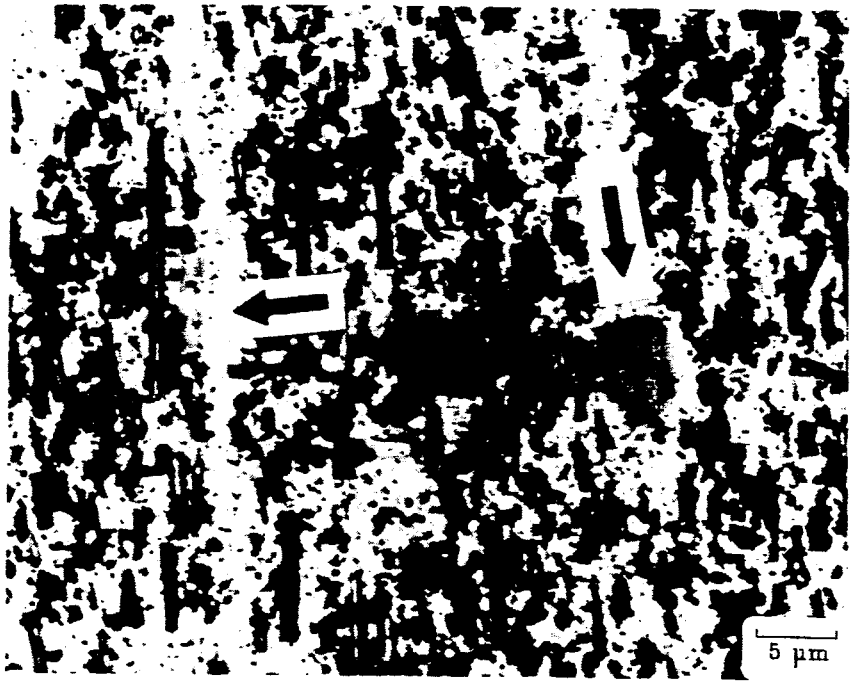
FIG. 2(*a*) and (*b*) an optical metallography comparison of a composite according to the invention and a conventional composite.
Figure 2B:
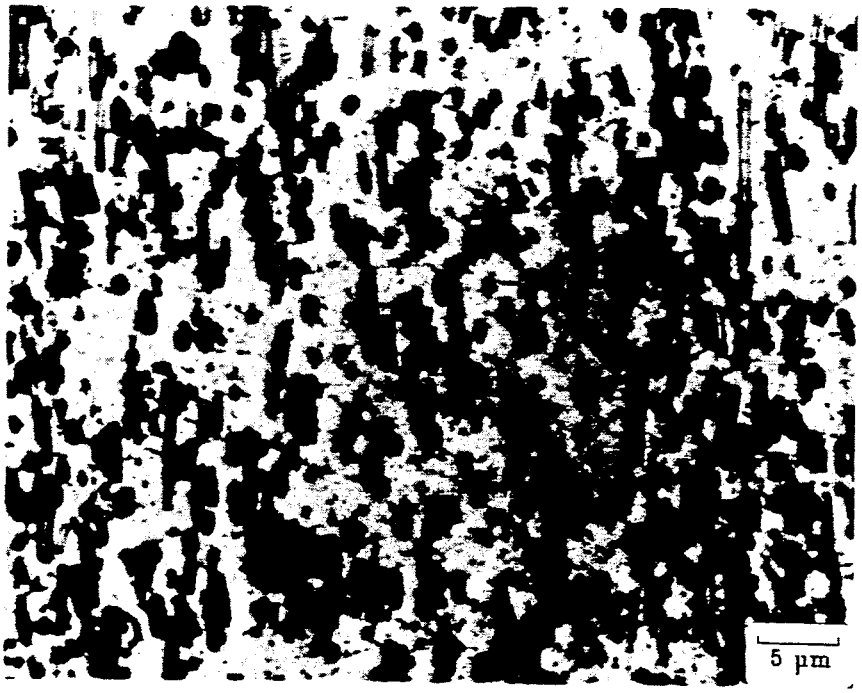

The difference in microstructure between SXA ®24/SiC and an SXA ®220 composite made according to the invention is shown in FIG. 2. In FIG. 2(*a*), the arrow identifies a large constituent particle in SXA ®24/SiC. X-ray diffraction identified Al, SiC, large undissolved $Al_2Cu$ and unidentified diffraction peaks. Based on the phases found in 2124, the unidentified peaks are probably from $Al_{20}Mn_3Cu_2$. These constituents particles were not found in the composite of invention after identical optical metallographic and x-ray diffraction examination, as shown in FIG. 2(*b*).

To demonstrate the advantage of the matrix alloy of the invention, the properties of a composite made in accordance with one form of the invention (i.e., the first group of composites) and a composite made conventionally are compared in FIG. 5. To assure that the data discriminated only effects of the matrix chemistry, the type and amount of reinforcement (20% $SiC_w$) was held constant. The composites were fabricated into a 0.75" rod and a 0.25"×1.5" bar using the same extrusion parameters to eliminate potential differences due to the mode of fabrication. The precise composition of the composites shown on FIG. 5 is set forth in Table 3. Their tensile properties are shown in Table 4. Typical tensile test data (Table 4) indicate that the composite of the invention attains similar yield strength and stiffness as SXA ®24/SiC, but with 52% and 75% higher ductility in the extruded rod and bar, respectively.

Figure 5A:
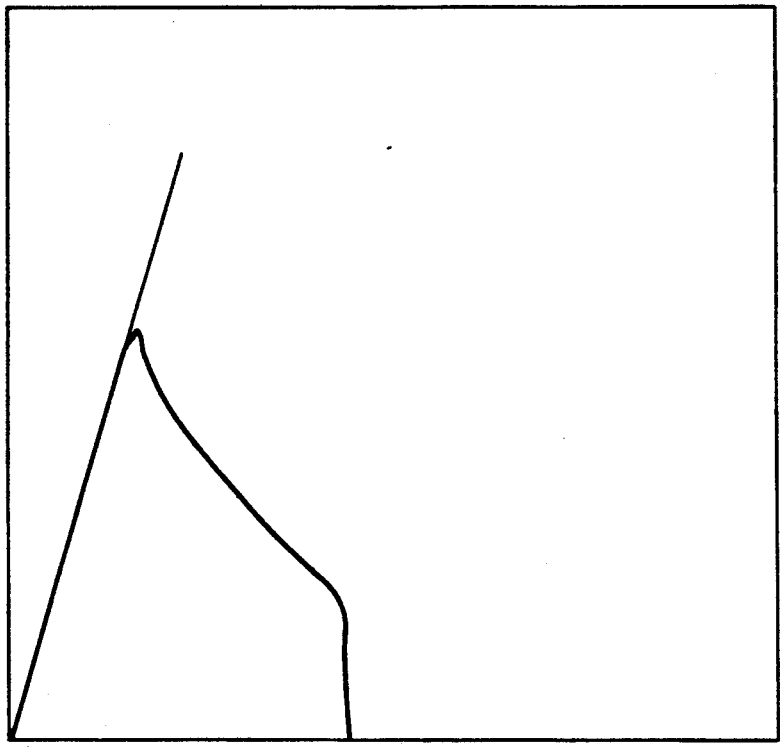
FIG. 5*a* is a graph of fracture toughness data for a conventional composite.
Figure 5B:
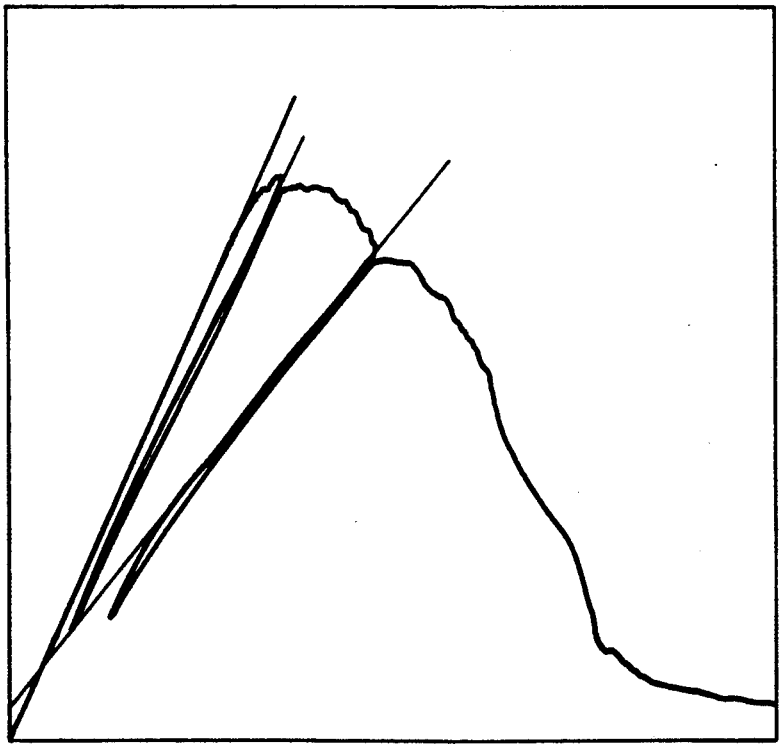
FIG. 5*b* is a graph of fracture toughness data for a composite according to the present invention.

The profound influence of a matrix alloy composition according to the invention on fracture toughness also is shown in FIG. 5, where typical load vs load-point opening curves for SXA ®220/SiC and SXA ®24/SiC are compared. The curve for SXA ®24/SiC (FIG. 5*a*) indicates that crack propagation occurred immediately after crack initiation, making a valid measurement of toughness impossible. Nevertheless, this behavior indicates the crack-propagation energy was less than the crack-initiation energy. In stark contrast, the curve for SXA ®220/SiC (FIG. 5*b*) allows measurement of the short-rod fracture toughness. Once the crack initiates, additional energy was needed to propagate the crack and allow a measurement of toughness.

TABLE 3

Composition of SXA ® 220/$20_w$-T6 and SXA ® 24/$20_w$-T6 Extrusions

| Composite | Weight Percent Cu | Mg | Mn | Fe | Si | Volume Percent $SiC_w$ |
|---|---|---|---|---|---|---|
| SXA ® $220^A$ | 2.27 | 1.08 | — | 0.01 | 0.11 | 20.9 |
| SXA ® $220^B$ | 2.95 | 1.37 | — | 0.01 | 0.14 | 19.3 |
| SXA24 | 4.44 | 1.63 | 0.55 | 0.05 | 0.10 | 19.7 |

TABLE 4

Tensile Properties of SXA ® 220/$20_w$-T6 and SXA ® 24/$20_w$-T6 Extrusions at Ambient Temperature (minimum 1 week exposure)

| Composite | Form | Tensile Strength (ksi) | Yield Strength (ksi) | Elongation To Failure (%) | Young's Modulus (Msi) |
|---|---|---|---|---|---|
| SXA ® $220^B$ | Bar | 106 | 65 | 4.2 | 18.5 |
| SXA ® 24 | Bar | 113 | 68 | 2.4 | 18.9 |
| SXA ® $220^A$ | Rod | 119 | 74 | 3.5 | 18.5 |
| SXA ® 24 | Rod | 117 | 72 | 2.4 | 19.6 |

2124 can contain copper in excess of the solubility limit at the customary 920° F. (493° C.) solution-heat-treatment temperature, which thereby assures maximum supersaturation to create maximum strength. A matrix alloy of the invention, however, can be aged to provide similar strength. By heating the composite of the invention to 920° F. (493° C.) and quenching to room-temperature (typically in water or a water/glycol solution), the alloy becomes susceptible to increased strengthening by natural aging and by artificial aging. Natural aging occurs spontaneously at room temperature whereas artificial aging is done at a slightly elevated temperature (usually less than 400° F. (204° C.)). The strength of the alloy of the invention can thus be made comparable to 2124.

The heat treatment and aging conditions for the conventional composite material SXA ®24/SiC are comparable to the composite material of the present invention. Thermal and precipitation hardening treatments were selected for each composite to provide a T6 condition. The solution treatment consisted of heating each composite to a temperature between 920° F. (493° C.) and 932° F. (500° C.) for a period sufficient to dissolve the soluble phases. After solution treatment, the composite of invention was quenched in room temperature water. The quenched composites were then reheated to 320° F. (160° C.) and soaked for 10–24 hours to impart similar artificially-aged microstructure (composed of strengthening precipitates) which gives similar yield strength.

Figure 10:
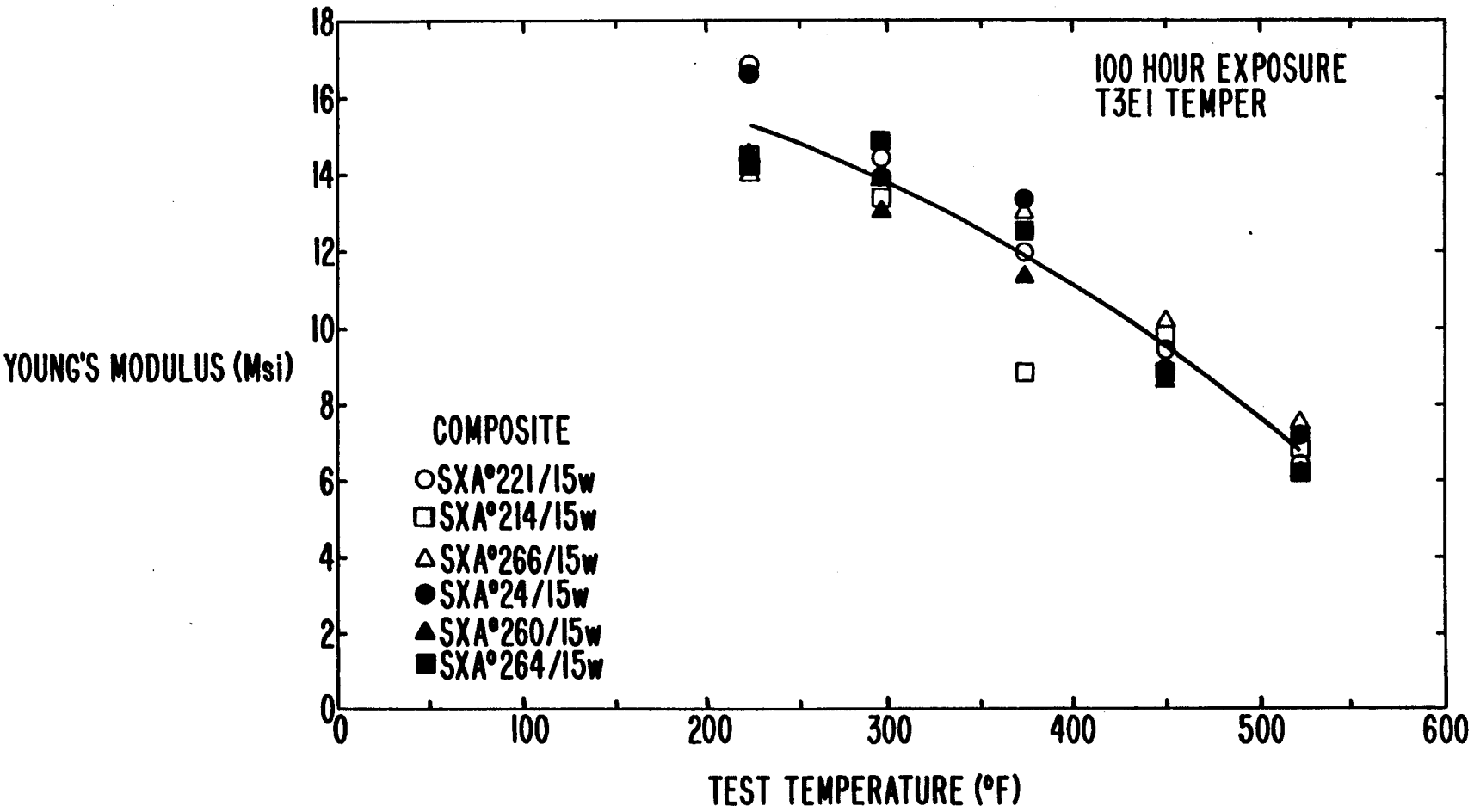
FIG. 10 is a graph of Young's modulus as a function of temperature for several composites according to the invention.

Similar data a results were obtained for the second group of composites of the invention as shown in Table 2 and FIGS. 6–10. These composites were formed into 0.1 inch thick sheet material and naturally aged to a T-3 temper. The tensile properties shown in Table 2 were measured at 225° F. (107° C.) after exposure for 10–100 hours. The composites are compared to a similarly formed sample from a conventional SXA ®24 composite. The tensile properties in Table 2 are also shown graphically in FIGS. 7–9 as a function of temperature. Young's modulus as a function of temperature is shown in FIG. 10. It is observed that for all the composites shown, the yield strength and tensile strength tend to coverage at approximately 500° F. (260° C.).

Figure 3:
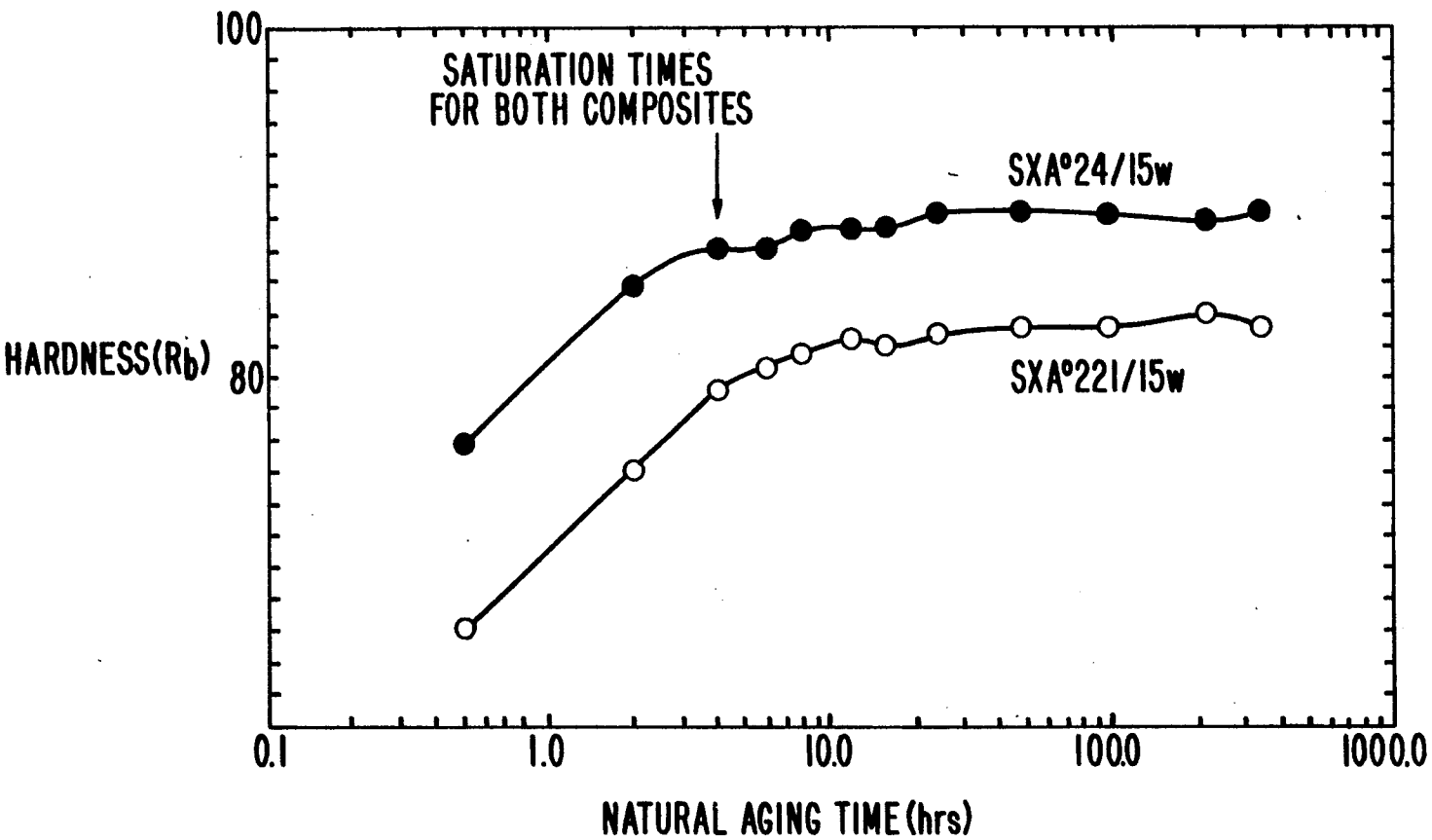
FIG. 3 is a graphical comparison of the hardness as a result of natural aging of a composite according to the present invention and a conventional composite.
Figure 4:
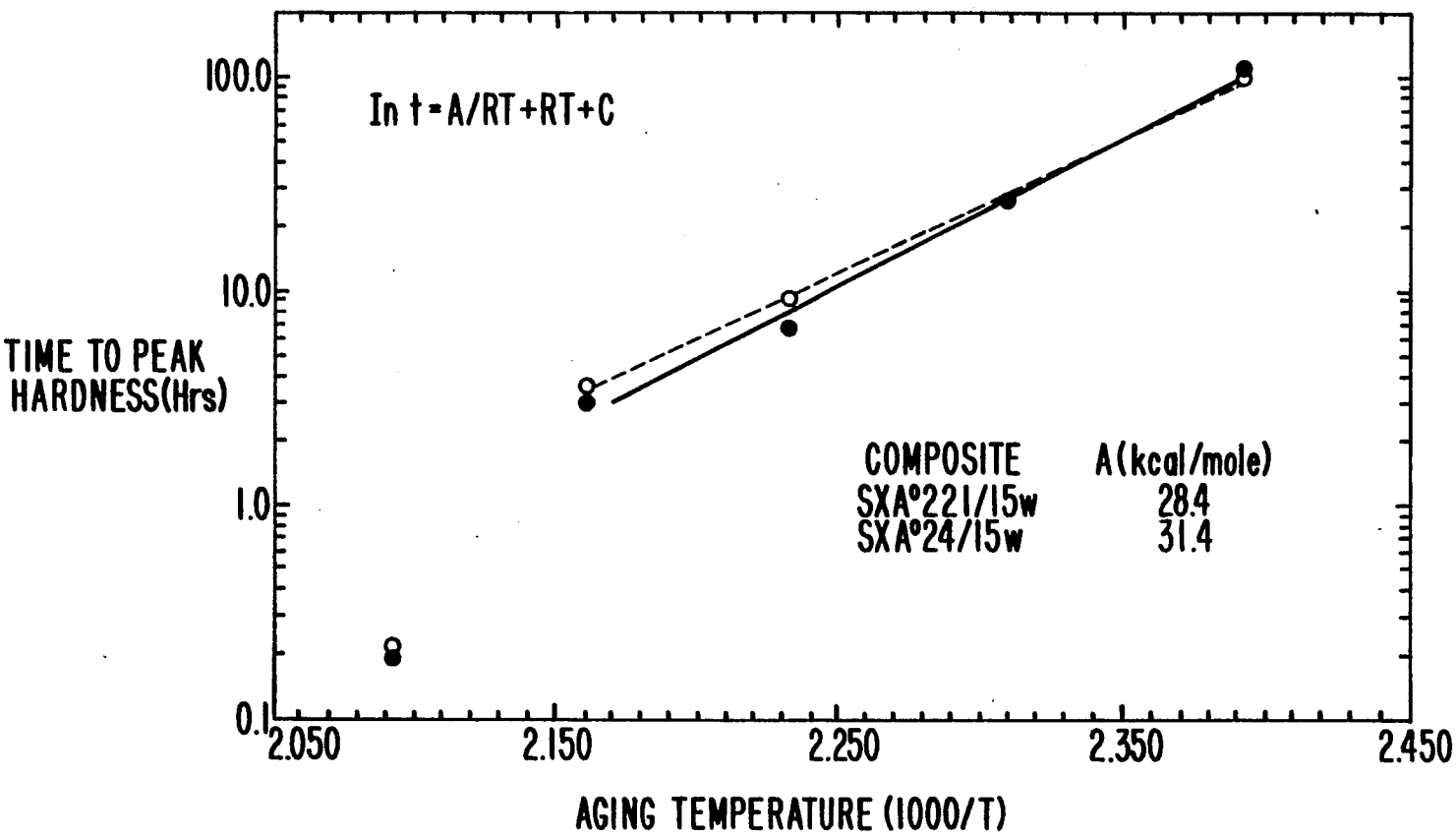
FIG. 4 is a graphical comparison of the time to peak hardness as a result of artificial aging of a composite according to the present invention and a conventional composite.

The composite material of the present invention displays similar natural aging and artificial aging traits as SXA ®24/SiC, as shown in FIGS. 3 and 4, respectively. The aging of one composite material according to the present invention, consisting essentially of a matrix alloy of copper and magnesium with 0.1% zirconium and reinforced with 15 volume percent silicon carbide whiskers, identified as SXA ®221/15w, is compared to a similarly reinforced conventional composite material, SXA ®24/15w. As shown, the two composites age similarly.

Since aging is a thermally-activated process, the time required for a certain property change (such as a maximum on a hardness/aging curve) shows an exponential relationship such that:

$$\log t = A/RT + B$$

where t is time, T is the absolute temperature of aging (Kelvin), R is the universal gas constant, A is a constant asumed to represent the sum of the activation energies for the aging process and B is a constant. Values of A, represented by the slopes of the straight segments in the plot of 1000/T verses log t for SXA ®24/SiC and SXA ®221/SiC, are similar (FIG. 4), and thereby indicative of similarity of the artificially-aged microstructures. This similarity is expected since the Cu/Mg ratios of the alloys are similar (about 2.2:1) and the amount of Cu and Mg available for precipitation is determined by the solution heat treatment temperature (FIG. 1). Some of the earliest microstructural examinations of the age hardening characteristics of Al-Cu-Mg alloys were done using compositions similar to the SXA ®220 matrix (i.e., without zirconium). The generally accepted natural and artificial aging characteristics for these alloys and 2124 are similar. Furthermore, the addition of SiC to 2124 does not change the type of phases which form during aging. Microstructural examination has shown the same types of strengthening phase present in natural and artificially aged 2124 and SXA ®24/SiC.

Prior to artificial aging, the composite may be cold-worked to relieve quench stresses and to straighten the fabricated part. This cold-work is usually applied by (but not limited to) stretching. About 1.2% stretch (after the cold water quench from the solution-heat-treatment temperature) increases the tensile yield strength (depending on the type and amount of SiC) about 30 ksi with a concomitant decrease in ductility nearly proportional to the amount of stretch. Up to about 0.6% stretch will increase tensile yield strength 10 to 15 ksi without significantly affecting the ductility. Thus, a degree of cold work after solution heat treatment is desirable because it can significantly improve the tensile yield strength of the composite without adversely affecting the ductility.

Figure 6B:
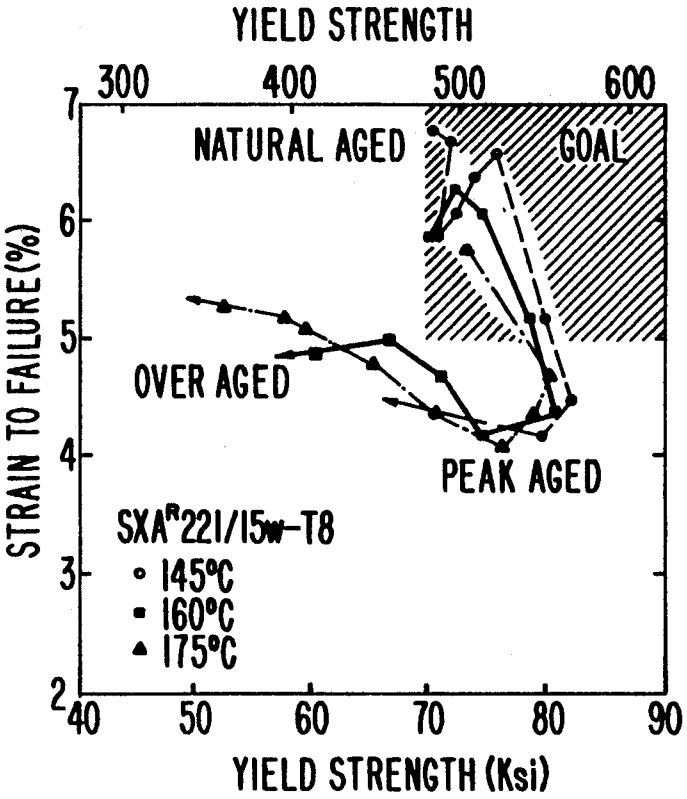
FIG. 6*b* is a graphical illustration of the effect on aging of the ductility of a composite according to the present invention.
Figure 6A:
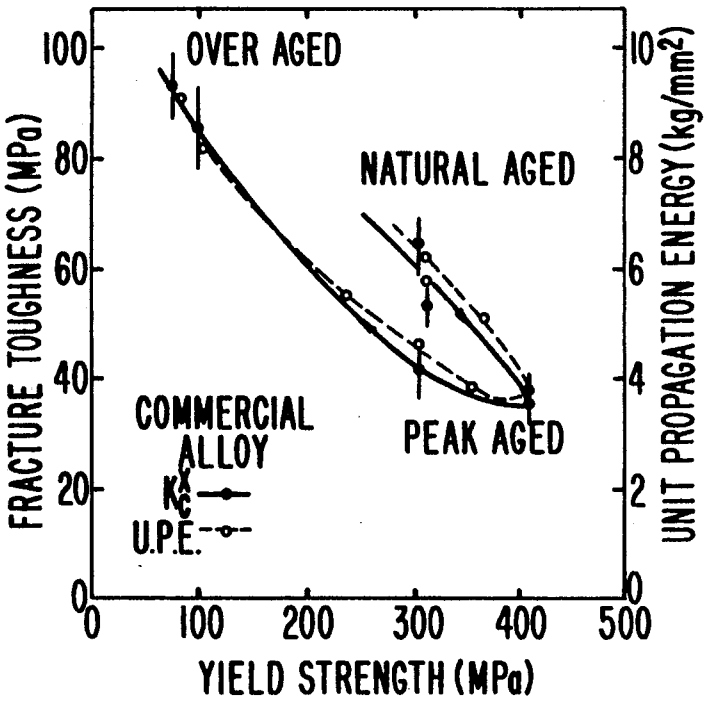
FIG. 6*a* a graphical illustration of the effect of aging on the fracture toughness of a conventional alloy.
Figure 7:
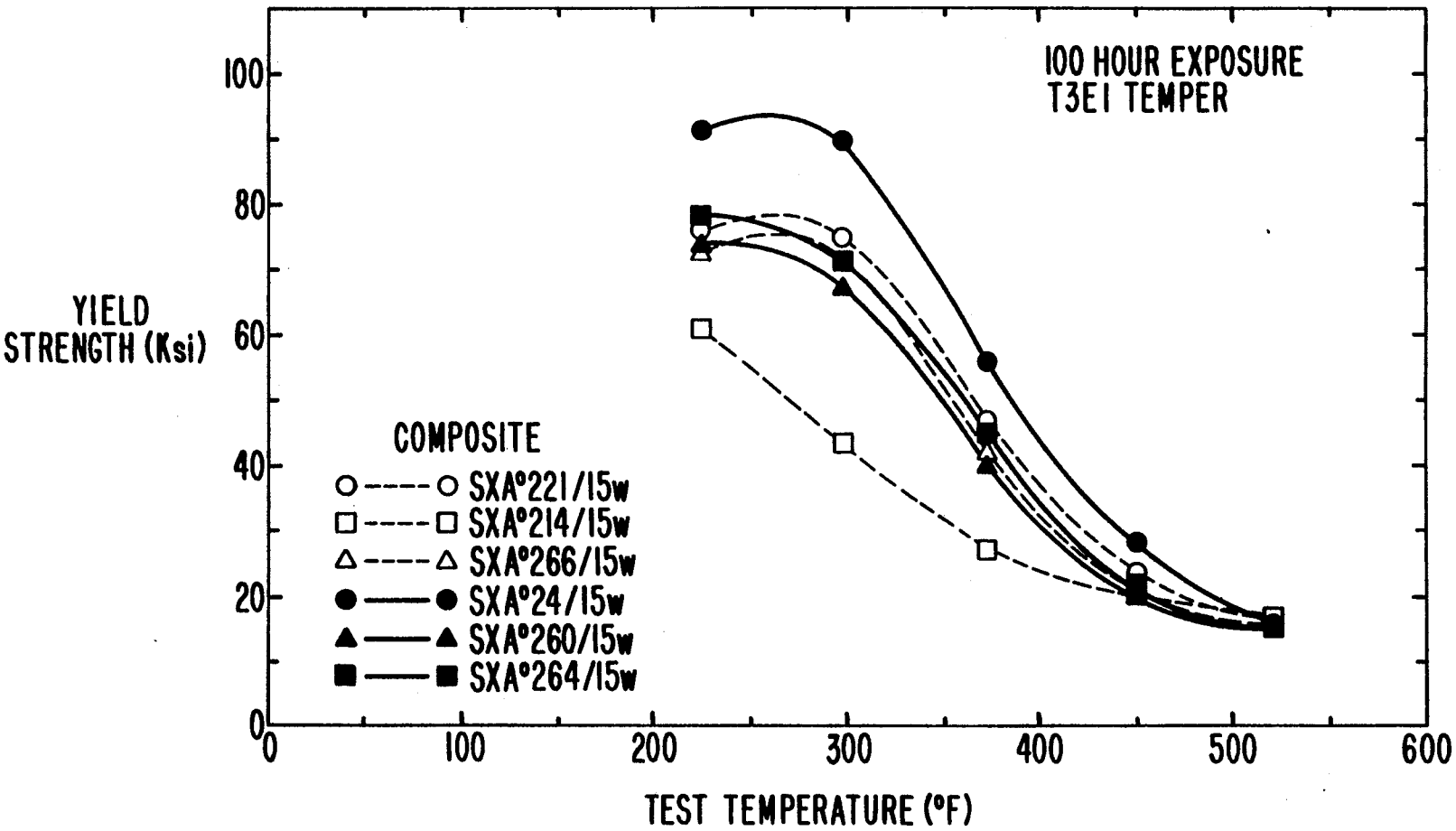
FIG. 7 is a graph of yield strength as a function of temperature for several composites according to the invention.
Figure 8:
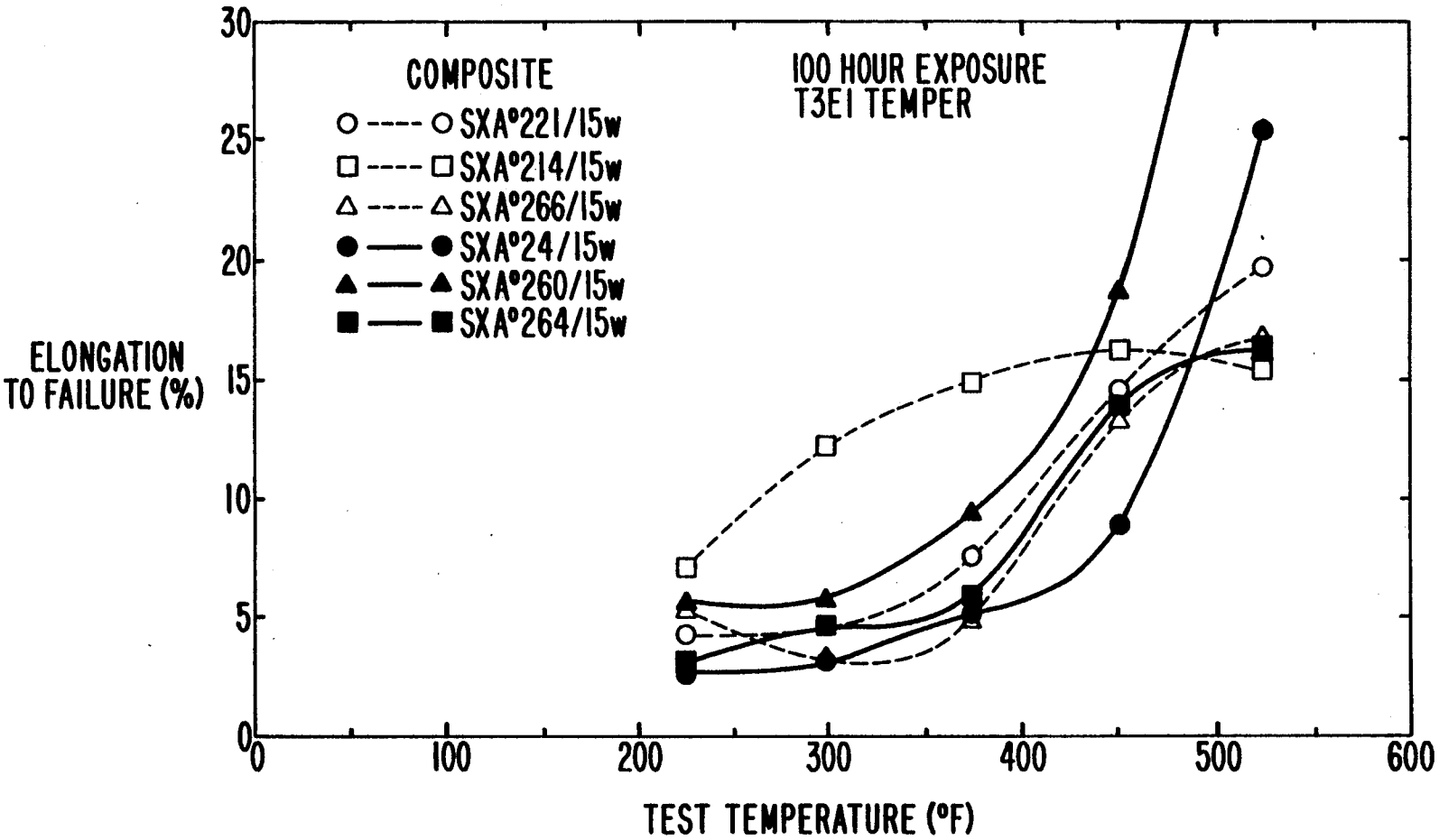
FIG. 8 is a graph of elongation to failure as a function of temperature for several composites according to the invention.
Figure 9:
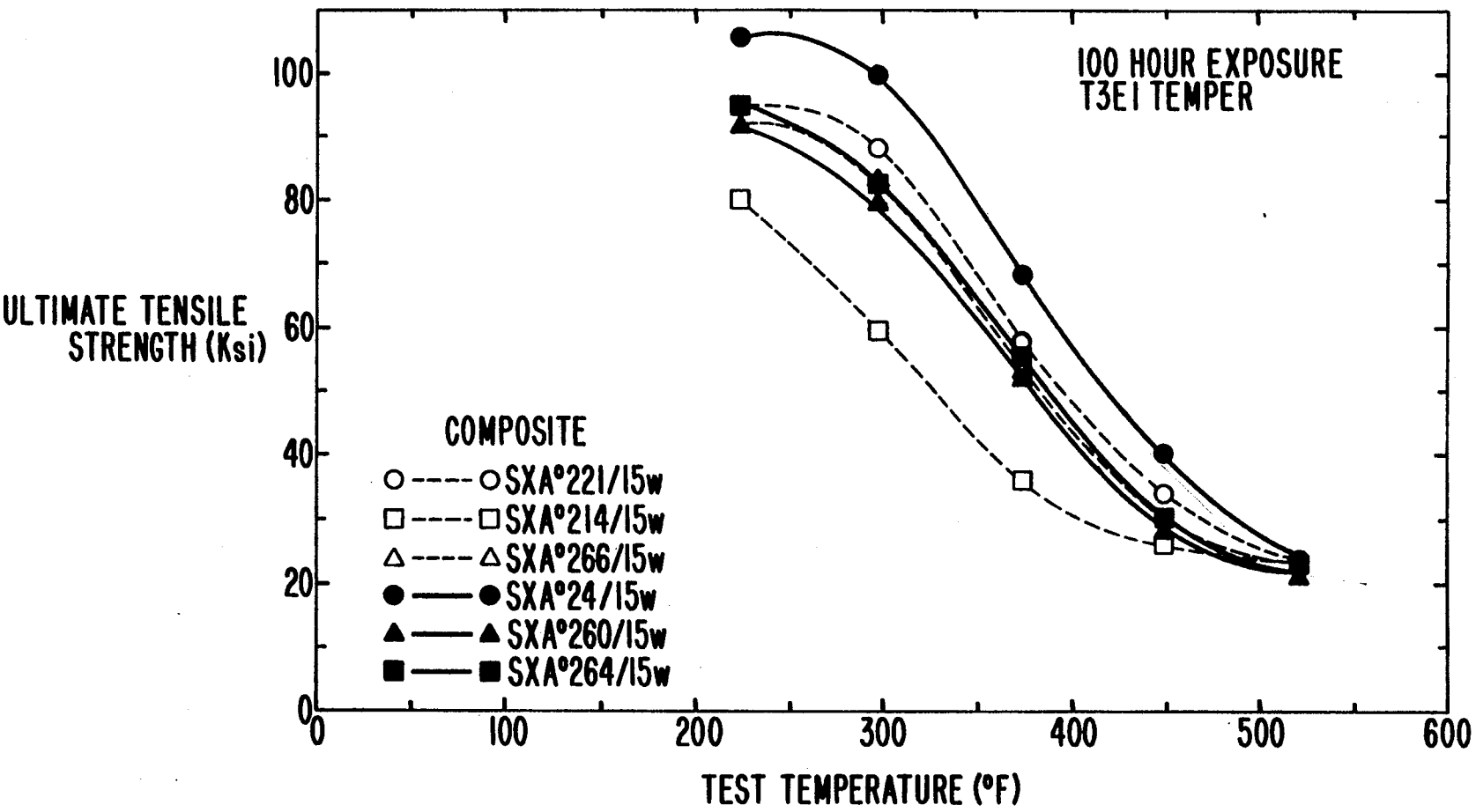
FIG. 9 is a graph of tensile strength as a function of temperature for several composites according to the invention.

Further enhancement of toughness is anticipated in the natural-aged condition, which displays the best ductility (FIG. 6). At any common strength, the ductility of SXA ®221/SiC is better in an underaged temper than in an overaged temper. The form of the relationship depicted between strength and ductility (FIG. 6(*b*)) is analogous to the relationship between strength and fracture toughness of an unreinforced Al-Cu alloy (FIG. 6(*a*)).

The composites of the invention, unlike unreinforced 2124, acquire most of their maximum-attainable-strength in natural-aged temper conditions. Proportionally less hardening is attained by artificially aging SXA ®24/SiC or SXA ®220/SiC than by artificially aging unreinforced 2124. In light of the attendant decrease in ductility (and probably toughness) as inferred from FIG. 6 which accompanies the modest increase in strength gained by artificial aging, the natural aged temper is preferred over an artificial-aged temper in the present invention.

It becomes evident that toughness and ductility of a reinforced aluminum matrix is dependent on the matrix alloy composition having no more than a small percentage of insoluble metallic elements. The matrix alloy of the invention provides a composite which has toughness and ductility superior to conventional composites at equivalent yield-strength and modulus due to the elimination of insoluble and undissolved soluble intermetallic constituents.

Although particular examples have been disclosed, the invention is not necessarily limited thereto, and is defined only by the following claims.

We claim:

1. In a ceramic reinforced aluminum matrix composite having an aluminum alloy matrix reinforced with a ceramic material the improvement comprising an aluminum alloy matrix consisting essentially of aluminum and soluble amounts of copper and magnesium as the principal alloying elements, wherein said soluble amounts of said alloying elements are within the ranges of about 2.0–4.5% copper and about 0.3–1.8% magnesium, and a small percentage of insoluble metallic alloying elements in amounts which do not adversely affect ductility and fracture toughness of the composite, wherein said small percentage of insoluble metallic elements is not greater than 0.2%.

2. A composite material consisting essentially of an aluminum alloy matrix reinforced with a ceramic material wherein said aluminum alloy matrix consists essentially of 2.0–4.5% copper and 0.3–1.8% magnesium as the principal alloying elements forming a base alloy, other soluble alloying elements in amounts which do not exceed the solubility limits of said other alloying elements in said base alloy, and not greater than 0.2% insoluble metallic elements.

3. A composite material as recited in claim 2 wherein said other alloying elements are selected from the group consisting of silicon, silver, and zinc.

4. A composite material as recited in claim 2 wherein said ceramic reinforcement comprises 5–40 volume percent of the composite.

5. A composite material as recited in claim 4 wherein said ceramic reinforcement comprises particles, whiskers, or chopped fibers.

6. A composite material as recited in claim 4 wherein said ceramic reinforcement is selected from the group consisting of silicon carbide, silicon nitride, titanium nitride, titanium carbide, aluminum nitride, alumina, boron carbide, boron, magnesium oxide and graphite.

7. A reinforced aluminum matrix composite consisting essentially of:

an aluminum alloy matrix consisting essentially of soluble amounts of copper and magnesium as the principal alloying elements, wherein the copper and magnesium are within the ranges of about 2.0–4.5 weight percent copper and about 0.3–1.8 weight percent magnesium, and not greater than 0.2 weight percent of insoluble metallic elements; and 5–40 volume percent reinforcement of said aluminum alloy matrix.

8. A composite material as recited in claim 7 wherein said reinforcement is a ceramic reinforcement which comprises particles, whiskers or chopped fibers.

9. A composite material as recited in claim 8 wherein said ceramic reinforcement is selected from the group consisting of silicon carbide, silicon nitride, titanium nitride, titanium carbide, aluminum nitride, alumina, boron carbide, boron magnesium oxide and graphite.

10. A composite material as recited in claim 7 wherein said reinforcement is a metallic reinforcement.

11. A composite material as recited in claim 10 wherein said metallic reinforcement is tungsten.

12. A composite material as recited in claim 7 wherein said aluminum alloy matrix further includes other soluble alloying elements in amounts which do not exceed the solubility limits of said other alloying elements.

13. A composite material as recited in claim 12 wherein said other soluble alloying elements are selected from the group consisting of silicon, silver and zinc.

14. A composite material as recited in claim 12 wherein said other soluble alloying elements do not exceed about 0.4%.

15. A composite material as recited in claim 7 wherein said insoluble metallic elements are selected from the group consisting of manganese, chromium, iron, and zirconium.

16. A reinforced aluminum matrix composite consisting essentially of:

a matrix of a base aluminum alloy of 2.0–4.5% copper and 0.3–1.8% magnesium as the principal alloying elements;

other soluble alloying elements in amounts which do not exceed the solubility limits of said other soluble alloying elements in said base alloy;

not greater than 0.2% insoluble metallic alloying elements; and reinforcement of said matrix.

17. A composite material as recited in claim 16 wherein said reinforcement is a metal.

18. A composite material as recited in claim 16 wherein said reinforcement is a ceramic and wherein said ceramic is in the form of particles, whiskers, or chopped fibers.

* * * * *